US011898814B2

(12) United States Patent
Alicea, Jr.

(10) Patent No.: US 11,898,814 B2
(45) Date of Patent: Feb. 13, 2024

(54) OPERATING SYSTEMS FOR ELECTRONICALLY ACTUATED FIREARMS

(71) Applicant: Benjamin Alicea, Jr., Oldsmar, FL (US)

(72) Inventor: Benjamin Alicea, Jr., Oldsmar, FL (US)

( * ) Notice: Subject to any disclaimer, the term of this patent is extended or adjusted under 35 U.S.C. 154(b) by 29 days.

(21) Appl. No.: 17/815,036

(22) Filed: Jul. 26, 2022

(65) Prior Publication Data

US 2023/0099648 A1 Mar. 30, 2023

Related U.S. Application Data

(60) Provisional application No. 63/227,114, filed on Jul. 29, 2021.

(51) Int. Cl.

| | |
|---|---|
| ***F41A 19/59*** | (2006.01) |
| ***F41A 17/56*** | (2006.01) |
| ***F41A 19/16*** | (2006.01) |
| ***F41A 19/69*** | (2006.01) |
| *F41A 19/46* | (2006.01) |

(52) U.S. Cl.

CPC ..... *F41A 19/59* (2013.01); *F41A 17/56* (2013.01); *F41A 19/16* (2013.01); *F41A 19/69* (2013.01); *F41A 19/46* (2013.01)

(58) Field of Classification Search

CPC ..... F41A 19/59; F41A 19/16; F41A 19/69; F41A 19/46; F41A 17/56; F41A 17/22; F41A 17/24; F41A 17/26; F41A 17/28; F41A 17/06

USPC ..... 42/84; 89/135

See application file for complete search history.

(56) References Cited

U.S. PATENT DOCUMENTS

| | | | | |
|---|---|---|---|---|
| 1,331,018 | A | 2/1920 | Luthy | |
| 2,780,882 | A | 2/1957 | Temple | |
| 3,045,555 | A | 7/1962 | Stoner | |
| 3,301,133 | A | 1/1967 | Sturtevant | |
| 3,442,173 | A | 5/1969 | Muller | |
| 4,727,670 | A | 3/1988 | Krouse | |
| 4,793,085 | A | 12/1988 | Surawski et al. | |
| 5,251,533 | A | 10/1993 | Layton | |
| 5,465,518 | A | 11/1995 | Blaser | |
| 5,713,150 | A | 2/1998 | Ealovega | |
| 5,727,538 | A | 3/1998 | Ellis | |
| 6,412,207 | B1 | 7/2002 | Crye et al. | |
| 6,442,880 | B1 | 9/2002 | Allan | |
| 6,615,527 | B1 | 9/2003 | Martin | |
| 6,626,165 | B1 | 9/2003 | Bhogal | |
| 6,976,416 | B2 | 12/2005 | Ealovega | |
| 7,765,999 | B1 | 8/2010 | Stephens et al. | |
| 7,819,051 | B1 | 10/2010 | Beckmann et al. | |
| 8,336,438 | B2 | 12/2012 | Compton et al. | |
| 8,667,881 | B1 | 3/2014 | Hawbaker | |
| 8,807,007 | B2 * | 8/2014 | Alicea | F41A 19/59 89/28.1 |
| 9,151,559 | B2 * | 10/2015 | Alicea, Jr. | F41A 19/69 |
| 9,395,130 | B2 | 7/2016 | Jacobson | |

(Continued)

*Primary Examiner* — John Cooper

(74) *Attorney, Agent, or Firm* — Taft Stettinius & Hollister LLP

(57) ABSTRACT

There is disclosed herein systems, methods and apparatus relating to a firearm with an operating system for electronically firing the firearm to fire projectiles from the firearm. The operating system includes an electronic firing system with a switch that is actuated by pulling the trigger of the firearm.

20 Claims, 7 Drawing Sheets

(56) References Cited

U.S. PATENT DOCUMENTS

| | | | | |
|---|---|---|---|---|
| 9,429,379 | B2 | 8/2016 | Fellows | |
| 9,441,896 | B2 * | 9/2016 | Allan | F41A 17/30 |
| 9,551,546 | B2 * | 1/2017 | Alicea, Jr. | F41A 19/10 |
| 9,658,017 | B2 | 5/2017 | Alicea | |
| 10,030,928 | B2 | 7/2018 | Alicea, Jr. | |
| 10,107,580 | B2 | 10/2018 | Fellows et al. | |
| 10,113,823 | B2 * | 10/2018 | Alicea, Jr. | F41A 19/10 |
| 10,254,059 | B1 | 4/2019 | Fellows et al. | |
| 10,295,290 | B2 | 5/2019 | Fellows et al. | |
| 10,393,461 | B2 | 8/2019 | Fellows et al. | |
| 10,480,881 | B2 | 11/2019 | Fellows et al. | |
| 10,480,882 | B2 | 11/2019 | Fellows et al. | |
| 10,508,876 | B2 | 12/2019 | Alicea, Jr. | |
| 10,724,816 | B2 * | 7/2020 | Alicea, Jr. | F41A 17/22 |
| 10,731,938 | B2 * | 8/2020 | Alicea, Jr. | F41A 3/66 |
| 2006/0169268 | A1 | 8/2006 | Tippmann, Jr. | |
| 2009/0255160 | A1 * | 10/2009 | Summers | F41A 17/063 42/84 |
| 2010/0186277 | A1 | 7/2010 | Beckmann | |
| 2011/0061280 | A1 | 3/2011 | Emde et al. | |
| 2011/0232618 | A1 | 9/2011 | Gabrel | |
| 2013/0019510 | A1 | 1/2013 | Kemmerer et al. | |
| 2013/0019512 | A1 | 1/2013 | Kemmerer et al. | |
| 2013/0118050 | A1 * | 5/2013 | Alicea | F41A 19/69 42/84 |
| 2013/0125441 | A1 | 5/2013 | Westwood et al. | |
| 2013/0167423 | A1 | 7/2013 | Lupher et al. | |
| 2013/0180147 | A1 | 7/2013 | Lupher et al. | |
| 2015/0198402 | A1 | 7/2015 | Brace | |
| 2016/0018176 | A1 | 1/2016 | Fellows et al. | |
| 2017/0122686 | A1 | 5/2017 | Fellows et al. | |

* cited by examiner

OPERATING SYSTEMS FOR ELECTRONICALLY ACTUATED FIREARMS

CROSS-REFERENCE TO RELATED APPLICATION

The present application claims priority to and the benefit of U.S. Provisional App. No. 63/227,114 filed on Jul. 29, 2021, the disclosure of which is incorporated herein by reference.

BACKGROUND

Firearms typically rely on mechanical systems to control the firing of projectiles from the firearm. When firearms employ multiple mechanical firing modes, the complexity of the mechanical systems increase, and in some cases certain firing modes are not possible or feasible due to the mechanical complexity involved. In addition to increasing the number of components involved in the firing, the potential for failure increases due to wear and malfunction of the components.

Firearms with operating systems that electronically actuate to fire the firearm present an opportunity to reduce the mechanical complexity of firearms, particularly those with multiple firing modes. The operating systems for electronic actuation can also provide certain improvements in the operation of the firearm over mechanical systems. Therefore, further improvements in operating systems for electronically actuated firearms are desirable.

SUMMARY

There is disclosed herein systems, methods and apparatus relating to electronically actuated firearms and operating systems for the same that are operable to fire projectiles from the firearm. In an embodiment, the systems, methods and apparatus include operating mechanisms for mechanically and/or electronically actuating a firearm.

This summary is provided to introduce a selection of concepts that are further described below in the illustrative embodiments. This summary is not intended to identify key or essential features of the claimed subject matter, nor is it intended to be used as an aid in limiting the scope of the claimed subject matter. Further embodiments, forms, objects, features, advantages, aspects, and benefits shall become apparent from the following description and drawings.

DESCRIPTION THE ILLUSTRATED EMBODIMENTS

Figure 1:
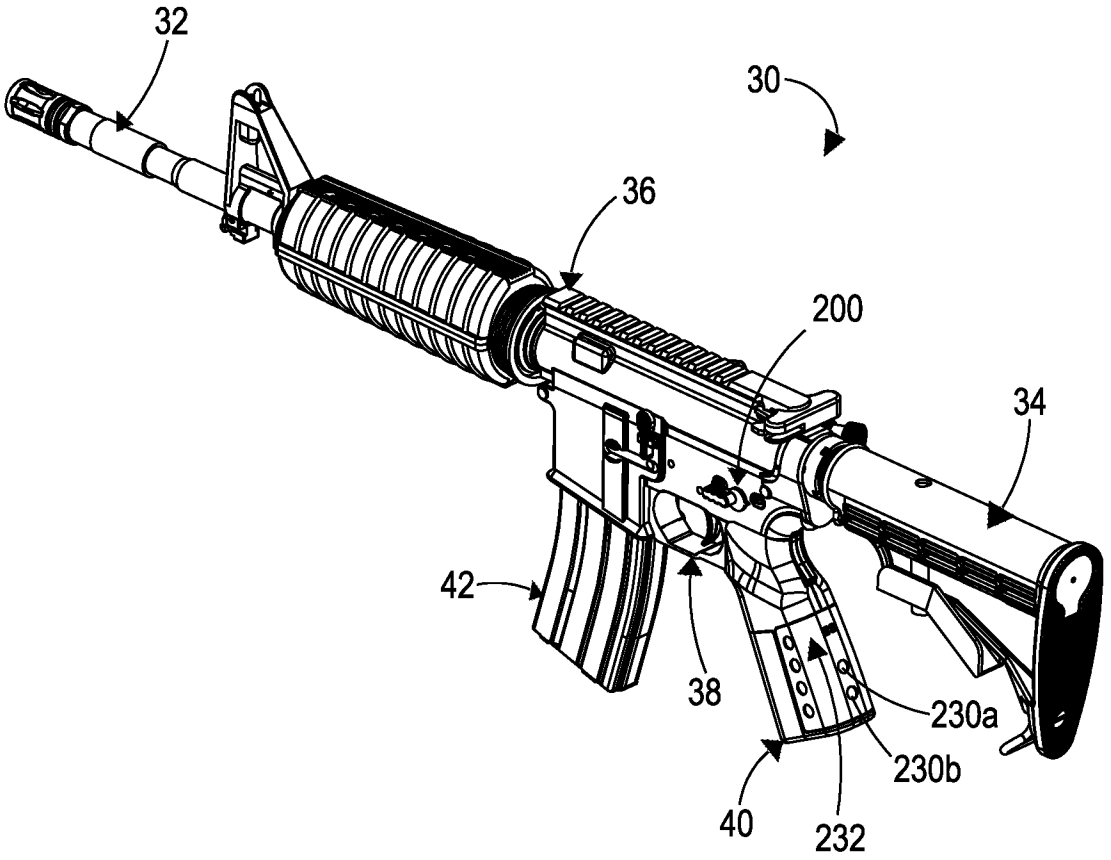
FIG. 1 is a perspective view of one embodiment of a firearm according to the present disclosure.

For the purposes of promoting an understanding of the principles of the invention, reference will now be made to the embodiments illustrated in the drawings and specific language will be used to describe the same. It will nevertheless be understood that no limitation of the scope of the invention is thereby intended, any alterations and further modifications in the illustrated embodiments, and any further applications of the principles of the invention as illustrated therein as would normally occur to one skilled in the art to which the invention relates are contemplated herein.

Referring to FIG. 1, there is shown a selective fire firearm 30 that includes a barrel 32, a butt stock 34, an upper receiver 36, and a lower receiver 38. Selective fire firearm 30 also includes a grip assembly 40 and a magazine 42 secured to lower receiver 38. It should be understood that not all details of selective fire firearm 30 are shown and/or described, it being understood that the present disclosure has application to any firearm that is a selective fire type weapon, including an M-16, M-4, AK-47 type firearms, sub-machine guns, and HK style firearms.

Referring further to FIGS. 2-6, selective fire firearm 30 further includes a mechanical firing system 66 generally associated with lower receiver 38 and an electronic firing system 68 generally associated with grip assembly 40. Electronic firing system 68 is structured to selectively interface with and operate mechanical firing system 66 in an electronic firing mode of selective fire firearm 30. Selective fire firearm 30 includes a selector mechanism 200 that includes a mode selector 204 that is movable between, for example, four positions that each define and configure selective fire firearm 30 in a corresponding operating mode for firing projectiles.

Figure 2:
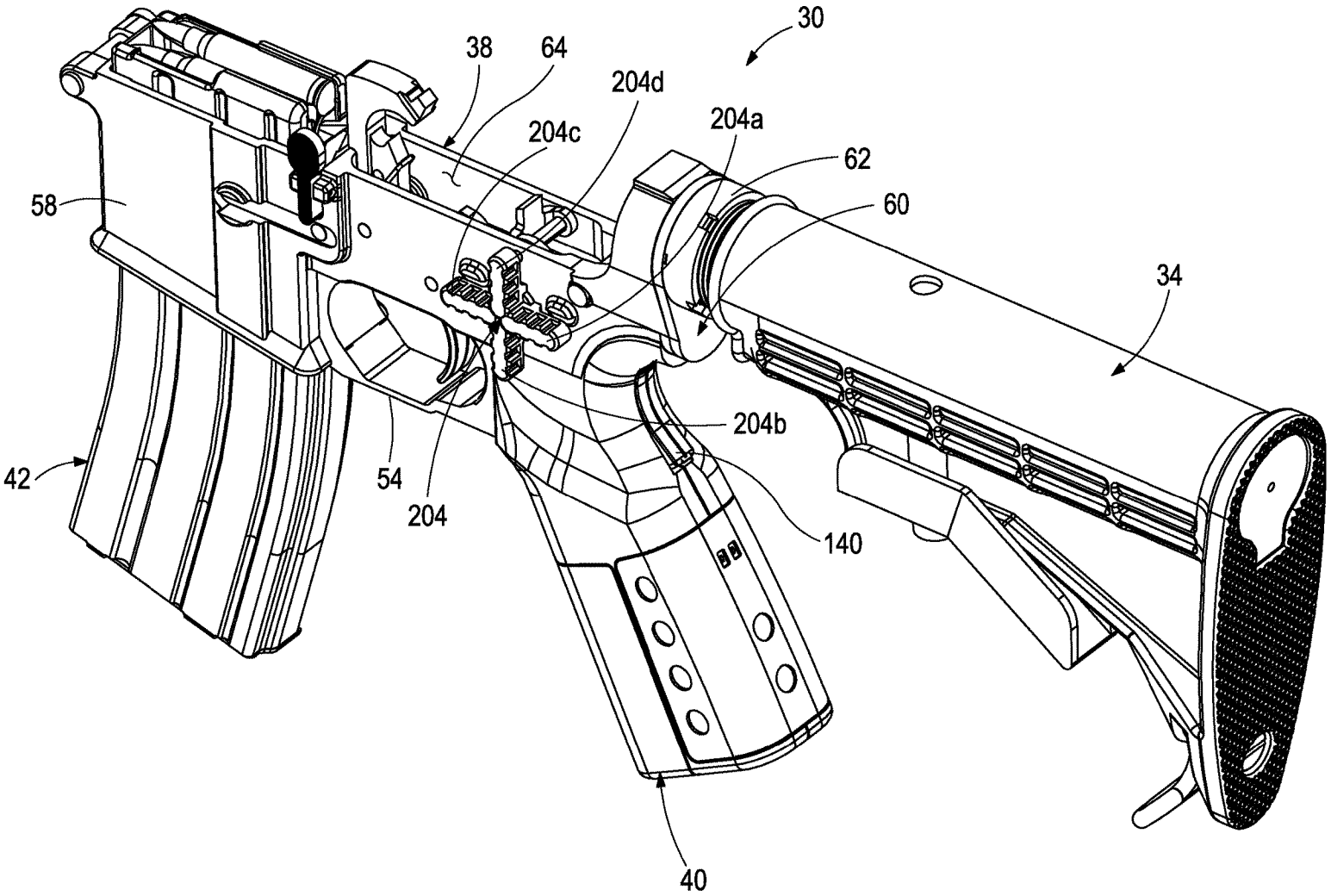
FIG. 2 is a perspective view of the lower receiver, grip assembly and buttstock of the firearm of FIG. 1.

As shown in FIG. 2, in one embodiment the predefined positions for mode selector 204 include: a safety mode position 204*a*, a semi-automatic firing mode position 204*b*, an automatic firing mode position 204*c*, and an electronic firing mode position 204*d*. As used herein, an automatic firing mode includes a fully automatic firing mode in which a single pull continuously fires rounds until the trigger is released or the ammunition is depleted, and a burst firing mode in which more than one round but less than all the available rounds are fired in a single trigger pull, such as a three shot burst. Other embodiments contemplate more or fewer modes for selection, and different types of modes and mode selectors. For example, a fully automatic mode may be omitted, and/or multiple electronic firing modes may be provided.

Lower receiver 38 includes a magazine holder 58 for receiving magazine 42 and a housing 60 with a buffer tube or stock assembly attachment member 62 at a rearward end thereof. Housing 60 defines a compartment 64 for housing at least a portion of mechanical firing system 66, such as a sear assembly 70 and a trigger 90. Other embodiments contemplate a hammer and/or auto sear as part of a mechanical firing assembly 66. Trigger 90 is coupled to sear assembly 70 with a pin arrangement 94, which also couples sear assembly 70 to lower receiver 38. A hammer 91 is movable between a cocked position to a released position by pulling of trigger 90. Trigger 90 can be housed in a trigger guard 54 of lower receiver 38. Trigger guard 54 is shown as fixed or non-removable, but can also be removable from lower receiver 38.

As shown in FIG. 2, mode selector 204 is provided as part of selector mechanism 200 and is rotatably mounted to lower receiver 38. As mentioned above, in one embodiment mode selector 204 is movable between the safety mode position 204*a*, the automatic firing mode position 204*c*, and the electronic firing mode position 204*d*. In the safety mode position 204*a*, sear assembly 70 is blocked by a portion of selector mechanism 200 to prevent any mechanical firing mode of operation and the mode selection switch is off to prevent an electronic firing mode of operation. In the semi-automatic firing mode position 204*b*, the sear assembly 70 allows a semi-automatic mode of operation. In the automatic firing mode position 204*c*, the sear assembly 70 provides an automatic mode of firing operation. In the electronic firing mode position 204*d*, the sear assembly 70 is not blocked by the mode selector to allow the electronically actuated actuator to pivot the sear assembly 70 to release the hammer. Further aspects of mode selector 204 are discussed in U.S. Pat. No. 10,724,816 issued on Jul. 28, 2020, which is incorporated herein by reference in its entirety. Other embodiments contemplate other types of mode selectors and/or modes of operation.

Figure 4:
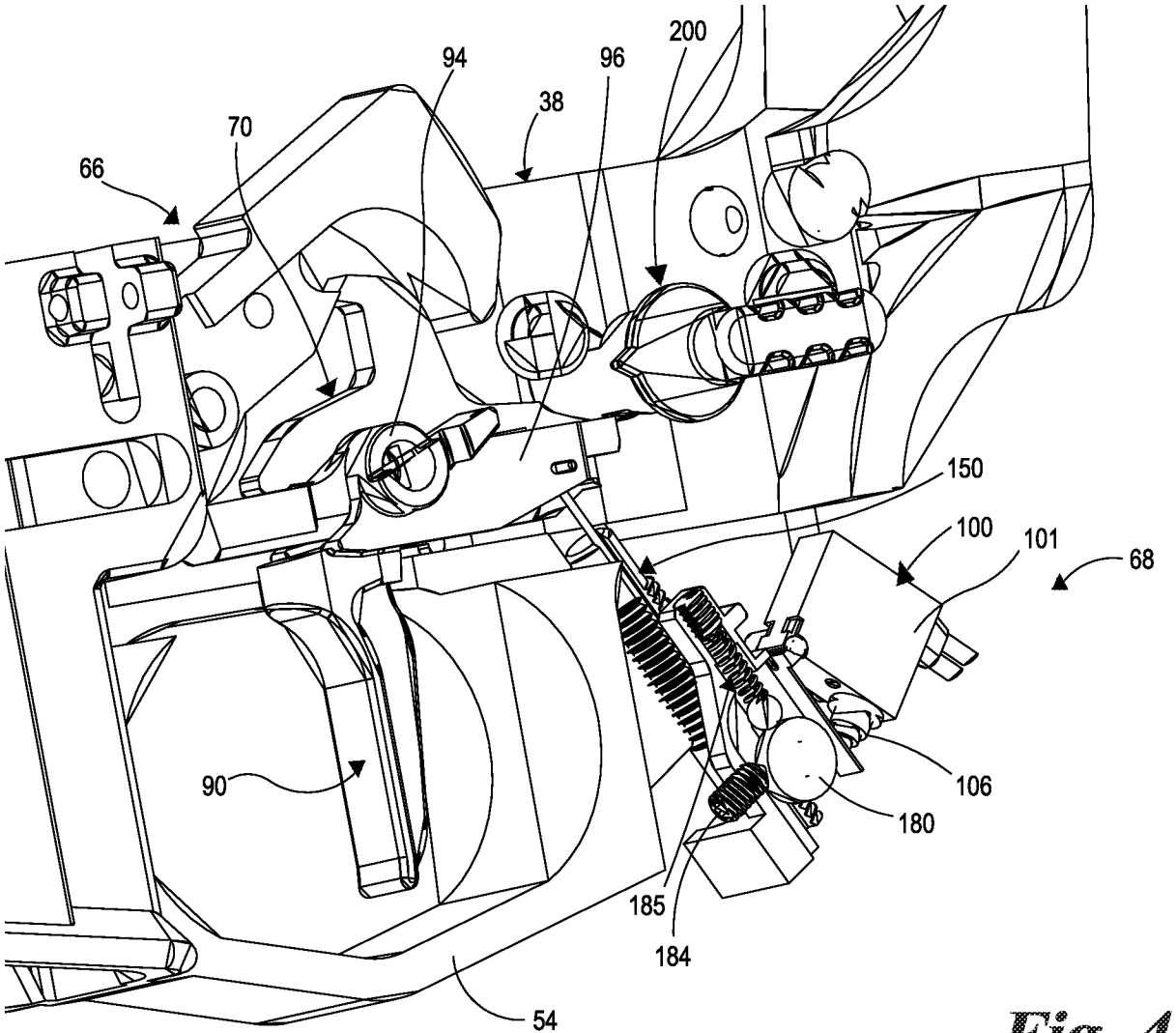
FIG. 4 is another perspective view similar to FIG. 3 but showing the lower receiver and with a casing of the operating system removed.
Figure 5:
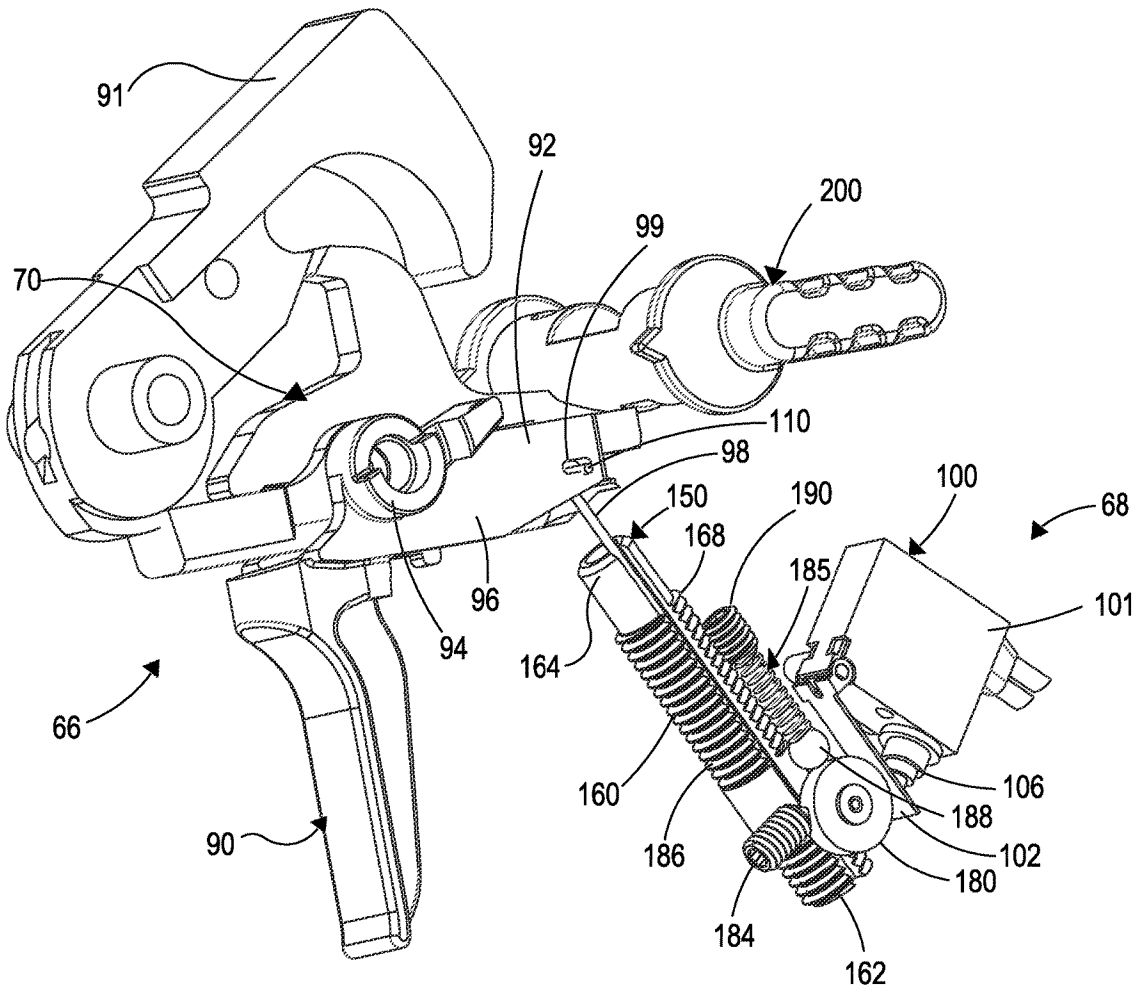
FIG. 5 is another perspective showing similar to FIG. 4 but with the outer part of the lower receiver and the casing of the operating system removed.
Figure 6:
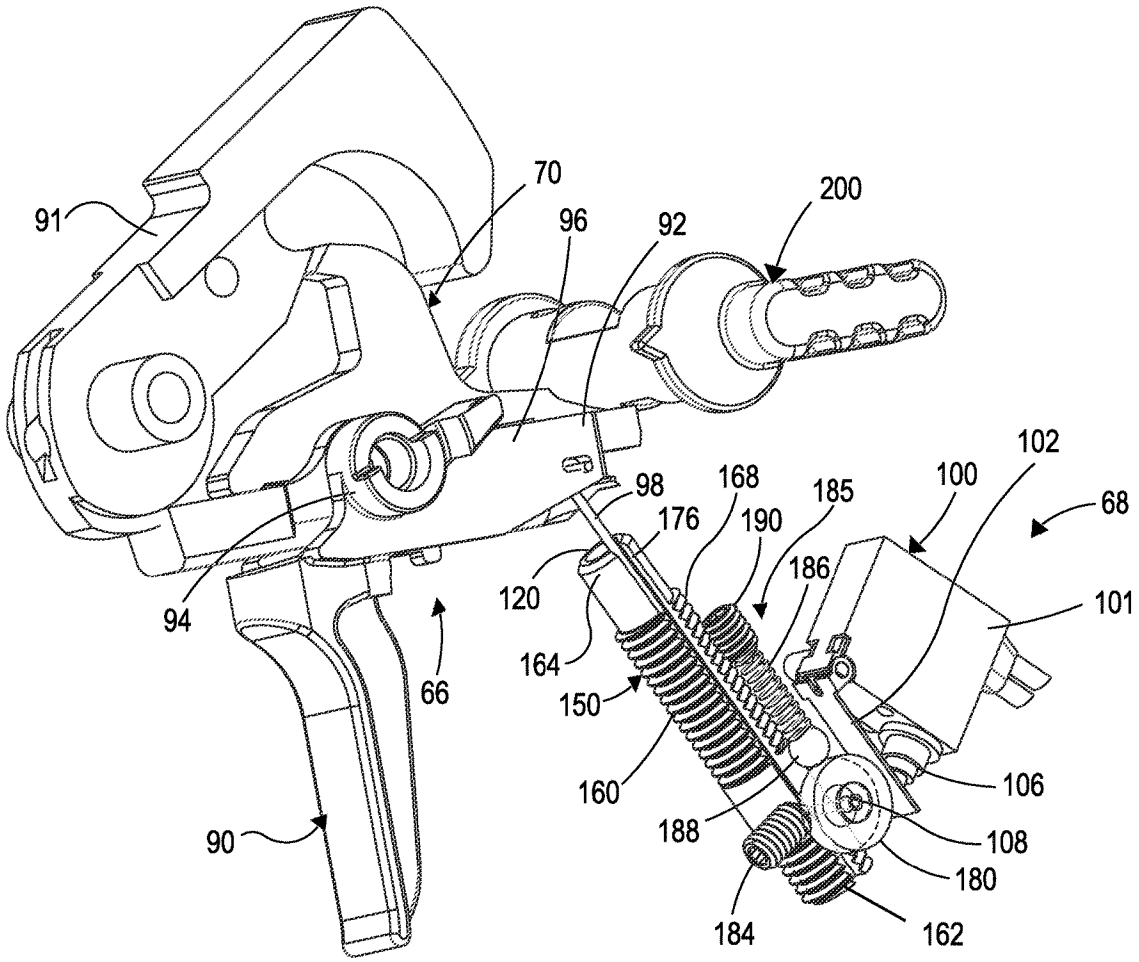
FIG. 6 is another perspective view similar to FIG. 5 but showing a roller of the operating system in transparency.

As further shown in FIGS. 4-6, trigger 90 includes a trigger arm 96 extending rearwardly from pin arrangement 94 at an upper end of trigger 90. Trigger arm 96 is connected at its outer rearward end 92 to a trigger lever 98. Trigger lever 98 extends into grip assembly 40 from trigger arm 96 toward a first switch 100. Trigger lever 98 is engaged to a roller 180, which is in contact with a switch actuator 102 and is moveable along switch actuator 102 in response to pulling and releasing of trigger 90. Pulling trigger 90 pivots trigger arm 96 to longitudinally displace trigger lever 98, which moves roller 180 along switch actuator 102. In one embodiment, switch actuator 102 is a flat metal tab or plate that is pivotal about a hinge to depress and release button 106 of switch 100. Switch actuator 102 is in engagement with button 106 of first switch 100 so that button 106 is selectively depressed and released to actuate first switch 100 by switch actuator 102 as roller 180 moves along switch actuator 102.

Trigger lever 98 includes an L-shaped engagement end portion 108 at a first end thereof that is engaged to roller 180. As further shown in FIG. 6, trigger lever 98 includes an L-shaped or other suitably shaped engagement arm 110 at a second end thereof that is received in a receptacle 99, such as a bore as shown, in trigger arm 96 at rearward end 92. Embodiments contemplate that receptacle 99 could be an elongated slot that is enclosed as shown, or open at one end to accommodate insertion of engagement arm 110 into receptacle 99. The pivoting movement of trigger 90 lifts trigger arm 96, which displaces trigger lever 98 to move roller 180 along switch actuator 102 toward the end of switch actuator 102 pivotally connected to the switch body 101.

Switch 100 is electrically connected to an electronic circuit which electronically controls an actuator and solenoid to fire selective fire firearm 30 in an electronic firing mode. An example of electronic circuit, solenoid and actuator are provided in the '816 patent referenced above. In general, first switch 100 is operable by trigger 90 to operate an actuator when the electronic firing system 68 is turned on or operationally enabled by a mode selector switch that is movable between an on position and an off position. The mode selector switch can be operable by selector mechanism 200 to allow the user or shooter to select the on/enable and off/disable positions for the electronic firing system 68.

Grip assembly 40 may further include a grip safety 140 (FIG. 2) that is pivotally mounted to a rearward side of grip assembly 40. Grip safety 140 can be configured to engage another switch (not shown) to provide a further enablement feature for the electronic firing mode of selective fire firearm 30 with trigger 90 when grip safety 140 is depressed by the shooter and when mode selector switch is on.

In certain embodiments, the actuator that is moved by the solenoid is a rod shaped member that is linearly movable in a longitudinal bore 170 of a fastening member 150 and engages, either directly or indirectly, a rearward end portion of the sear assembly 70. As the actuator moves upwardly and longitudinally through fastener 150, it pushes on sear assembly 70 to release engagement of the sear assembly with the hammer 91 from the cocked position to electronically fire the selective fire firearm 30.

Fastening member 150 includes an elongated body 160 extending between a first end 162 and an opposite second end 164. Fastening member 150 includes a threaded shaft portion 168 that extends therealong between first end 162 and second end 164. Shaft 168 may include a non-threaded portion or portions, and can be engaged to a nut 222 (FIG. 7) or other threaded structure to secure fastening member 150 thereto.

Body 160 further defines a longitudinal bore 170 that extends between and opens at first end 162 and second end 164. Body 160 also includes a longitudinal slot 176 paralleling the bore that receives the trigger lever 98 therein to guide the longitudinal movement of trigger lever 98. Engagement end portion 108 projects outwardly from slot 176 to engage the roller 180. The slot 176 can be separated from bore 170 by a wall of shaft 168, or can open into bore 170. First end 162 can be configured to engage a driving tool to drive fastening member 150 through grip assembly 40 and into a threaded bore in lower receiver 38 to secure grip assembly 40 to lower receiver 38.

In the illustrated embodiment, although fastening member 150 is shown with a threaded shaft 168, a threaded engagement between fastening member 150 and lower receiver 38 is not required. Any suitable fastening arrangement is contemplated. In still other embodiments, the actuator does not extend through a fastening member that fastens grip assembly 40 to lower receiver 38, and any suitable fastening member secured to at least one part or portion of the firearm to another which defines a travel path for actuator and/or trigger lever 98 is contemplated.

Figure 3:
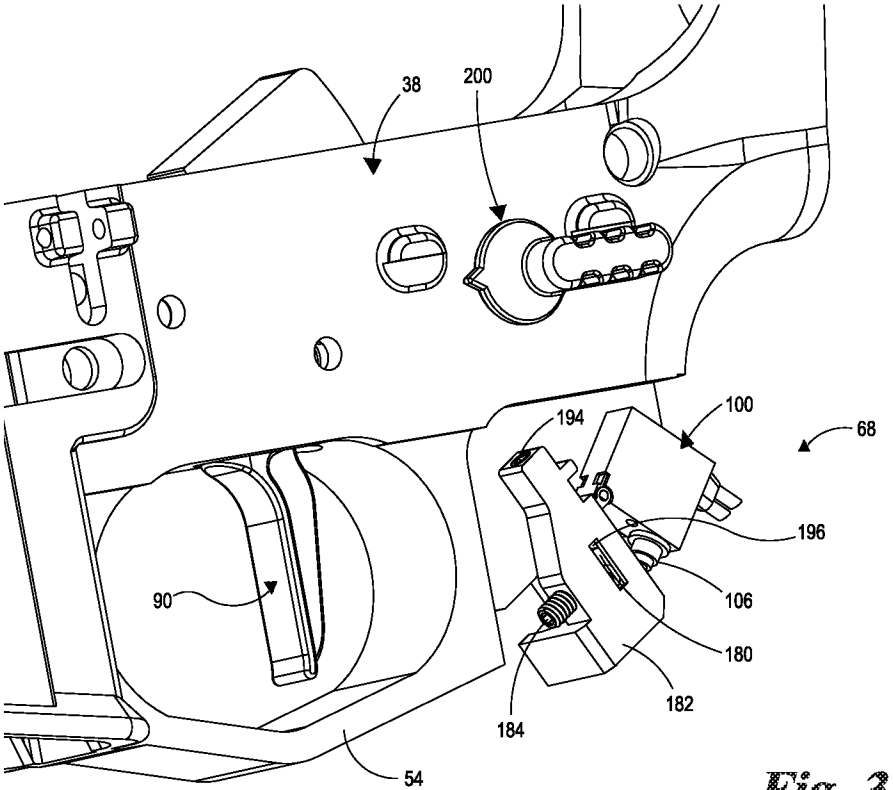
FIG. 3 is a perspective view of part of the lower receiver of FIG. 2 showing a part of an operating system that is actuated by the trigger.

Casing 182 is shown in FIG. 3, and is removed in FIG. 4 for clarity of the other components. Casing 182 can be mounted in the grip assembly 40. The roller 180 is mounted within an interior of casing 182 in engagement with trigger lever 98, and allowed to translate up and down along switch actuator 102 along slot 176 in response to actuation of trigger 90. The adjustment mechanism 184 contacts and displaces the roller 180 against switch actuator 102 to electronically fire the firearm in response to the roller 180 being pulled upwardly in casing 182 when the trigger 90 is pulled. The adjustment mechanism 184 can be, for example, a set screw threaded into or out of casing 182 to adjust the contact force/timing of roller 180 with switch actuator 102. The end of set screw in contact with roller 180 can be tapered to displace roller 180 against switch actuator 102 as the roller 180 is translated by trigger lever 98 during a pull of the trigger 90. Roller 180 is visible through window 196 of casing 182.

Casing 182 also includes a passage 194 (FIG. 3) that opens at an upper end of the casing 182 and houses an adjustment mechanism 185. The adjustment mechanism 185 can be operated to adjust the tension required to displace roller 180 in casing 182 in response to the pull of trigger 90. In the illustrated embodiment, adjustment mechanism 185 includes a spring 186, a ball member 188 at one end of spring 186 in contact with roller 180, and an adjustment screw 190 at the other end of spring 186 that can be rotated and/or threaded along the casing 182 to adjust the amount of biasing force of ball member 188 against roller 180, and the resultant force needed to displace roller 180 within casing 182 to depress the switch actuator 102.

Figure 7:
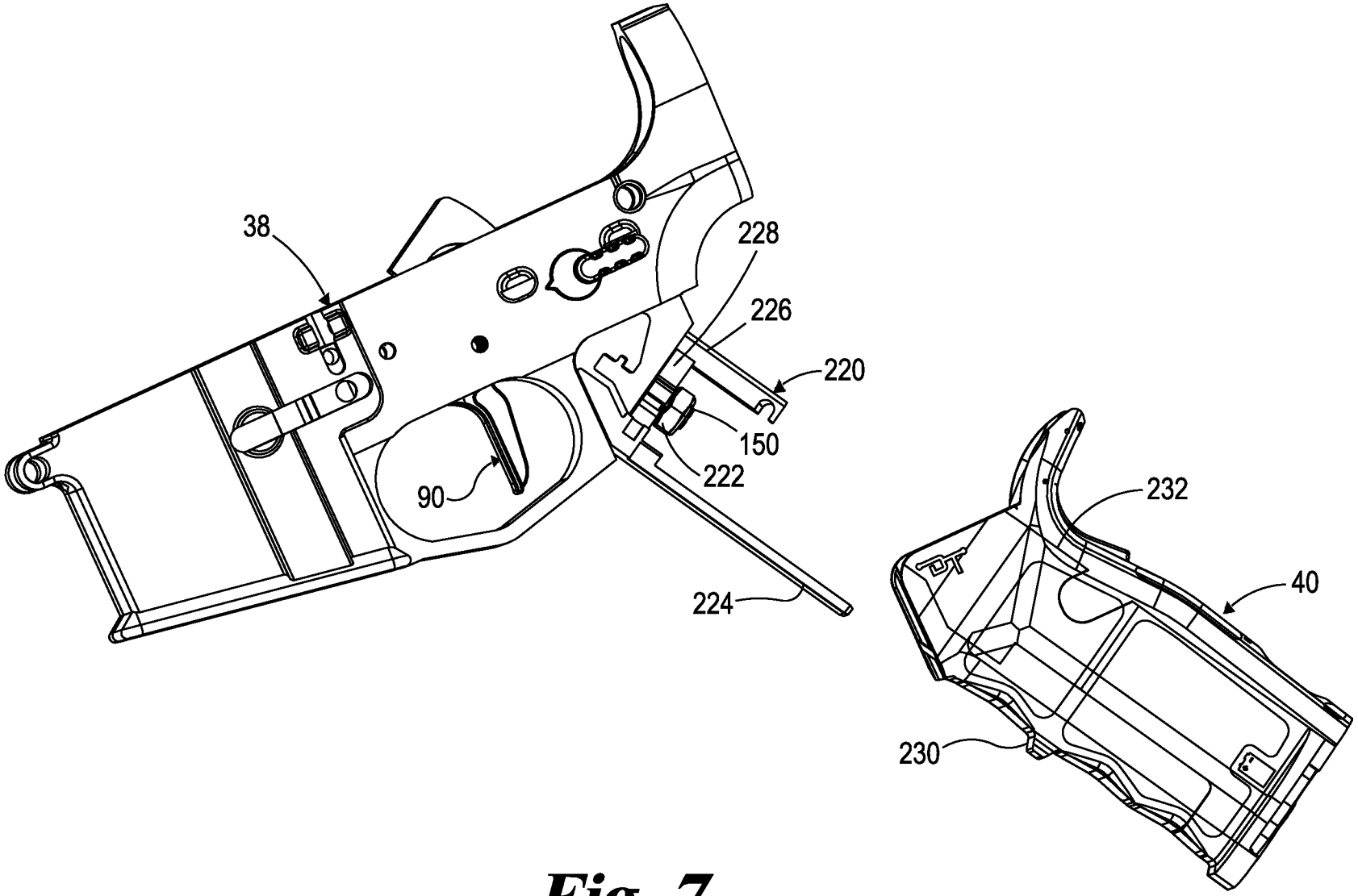
FIG. 7 is an exploded perspective showing an embodiment of a modular grip and chassis for attachment of the same to the lower receiver of the firearm of FIG. 1.

Referring to FIG. 7, an embodiment of grip assembly 40 is shown. In the illustrated embodiment, the lower receiver 38 includes a chassis 220 engaged thereto with fastening member 150 and nut 222. Chassis 220 includes a lower rail 224 and an upper rail 226 spaced apart from and parallel to lower rail 224. A base 228 extends between and connects rails 224, 226. Base 228 is fastened to the lower receiver 38 with fastener 150 and nut 222.

Grip 40 includes a first receptacle 230 for receiving lower rail 224, and a second receptacle 232 for receiving upper rail 226. The grip 40 can be easily attached to the lower receiver 38 by sliding the grip 40 onto the chassis 220. The disclosed arrangement provides a modularity for the exchange and/or replacement of grips. In addition, the stability of the assembly is improved by the additional support provided by rails 224, 226.

Electronic firing assembly 68 can be utilized in conjunction with existing semi-automatic and automatic weaponry designs to improve firearm operations and facilitate selection of the firing mode or safety of the firearm. In addition, the electronically controlled firing mechanism is beneficial in reducing uncertainties associated with trigger pull in mechanical systems, which is commonly known to effect shooting accuracy. Furthermore, the electronic firing assembly 68 includes a means for the shooter to select various manners in which firearm 30 will function when in the electronic firing mode.

Various aspects of the present disclosure are contemplated, as described herein and/or claimed below. According to one aspect, a firearm is provided. The firearm includes a lower receiver and a trigger pivotal relative to the lower receiver. The lower receiver includes a hammer moveable from a cocked position toward an uncocked position to fire the firearm. The lower receiver further includes a sear assembly positionable to secure the hammer in the cocked position, and the hammer is releasably engageable to the sear assembly. The firearm also includes a grip assembly attached to the lower receiver. The firearm further includes an operating system for electronically firing the firearm. The operating system includes a switch actuator and a switch for electronically firing the firearm, and a trigger lever connected to the trigger. The trigger lever is moveable in response to a pull of the trigger to displace a roller along the switch actuator to depress the switch actuator against the switch to fire the firearm.

In an embodiment, the firearm includes a casing in the grip assembly, and the roller is housed in the casing. In a refinement of this embodiment, the firearm includes an adjustment mechanism in the casing, and the adjustment mechanism is configured to adjust a force required to displace the roller in the casing.

In a further refinement of the above embodiment, the adjustment mechanism includes a ball member in contact with the roller, an adjustment screw engaged to the casing, and a spring between the ball member and the adjustment screw. In yet a further refinement, the casing includes a passage and the adjustment mechanism is housed in the passage.

In another refinement of the casing embodiment, the casing includes a set screw, and the set screw is configured to displace the roller against the switch actuator.

In another embodiment, the trigger lever is connected to the roller at one end of the trigger lever, and an opposite end of the trigger lever is connected a rearwardly extending arm connected to the trigger. In another embodiment, a fastening member attaches the grip assembly to the lower receiver, and the fastening member includes a slot and the trigger lever extends along the fastening member in the slot.

In another embodiment, a fastening member attaches the grip assembly to the lower receiver, and the fastening member includes a threaded shaft threadingly engaged to the lower receiver. In a refinement of this embodiment, the firearm includes a chassis engaged to the lower receiver via the fastening member.

In a further refinement of the above embodiment, the chassis includes a base engaged to the lower receiver with the fastener, a lower rail extending from one end of the base, and an upper rail extending from an opposite end of the base. In yet a further refinement, the grip assembly is attached to the lower rail and the upper rail of the chassis.

In another embodiment, the trigger is pivotally coupled with the sear assembly. Trigger includes a trigger arm extending rearwardly from the pivotal coupling of the trigger with the sear assembly, and the trigger lever is connected with a rearward end of the trigger arm.

In a refinement of the above embodiment, the trigger lever includes an engagement arm, the trigger arm includes a receptacle, and the engagement arm of the trigger lever is engaged in the receptacle of the trigger arm. In another refinement of the above embodiment, the trigger lever includes an L-shaped engagement member at one end of the trigger lever, the roller is engaged to the L-shaped engagement member, and the trigger lever is configured to displace the roller to ride along the switch actuator associated with the switch to actuate the switch in response to a pull of the trigger.

According to another aspect, an electronic firing system for firing a firearm by pulling a trigger is provided. The electronic firing system includes a switch actuator engaged to a switch, a trigger lever connectable to the trigger, and a fastening member configured to attach a grip assembly to a lower receiver of the firearm. The trigger lever is reciprocally moveable along the fastening member. The electronic firing system also includes a roller engaged to the trigger lever. The roller is configured to move along the switch actuator in response to a pull of the trigger that displaces the trigger lever, thereby displacing the switch actuator to engage the switch for electronically firing the firearm.

In an embodiment, the fastening member is configured to guide longitudinal movement of the trigger lever along the fastening member in response to a pull of the trigger as the trigger lever is displaced.

In an embodiment, the electronic firing system includes a casing mounted to the grip assembly. The roller is housed in the casing mounted to the grip assembly, and the casing includes an adjustment mechanism that is configured to adjust a force required to displace the roller by pulling the trigger. In a refinement of this embodiment, the adjustment mechanism includes a ball member in contact with the roller, an adjustment screw engaged to the casing, and a spring between the ball member and the adjustment screw.

In an embodiment, the electronic firing system includes a chassis engaged to the lower receiver via the fastening member. The chassis includes a base engaged to the lower receiver with the fastener, a lower rail extending from one end of the base, and an upper rail extending from an opposite end of the base. The grip assembly is mounted to the chassis via the lower and upper rails.

While the invention has been illustrated and described in detail in the drawings and foregoing description, the same is to be considered as illustrative and not restrictive in character, it being understood that only certain exemplary embodiments have been shown and described. Those skilled in the art will appreciate that many modifications are possible in the example embodiments without materially departing from this invention. Accordingly, all such modifications are intended to be included within the scope of this disclosure as defined in the following claims.

In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A firearm, comprising:

a lower receiver and a trigger pivotal relative to the lower receiver, the lower receiver including a hammer moveable from a cocked position toward an uncocked position to fire the firearm, the lower receiver further including a sear assembly positionable to secure the hammer in the cocked position, wherein the hammer is releasably engageable to the sear assembly;

a grip assembly attached to the lower receiver; and an operating system for electronically firing the firearm, the operating system including:

a switch actuator and a switch for electronically firing the firearm; and a trigger lever connected to the trigger; and a roller connected to the trigger lever, wherein the trigger lever is moveable in response to a pull of the trigger to displace the roller along the switch actuator to depress the switch actuator against the switch to fire the firearm.

2. The firearm of claim 1, further comprising a casing in the grip assembly, and the roller is housed in the casing.

3. The firearm of claim 2, further comprising an adjustment mechanism in the casing, wherein the adjustment mechanism is configured to adjust a force required to displace the roller in the casing.

4. The firearm of claim 3, wherein the adjustment mechanism includes:

a ball member in contact with the roller;

an adjustment screw engaged to the casing; and a spring between the ball member and the adjustment screw.

5. The firearm of claim 4, wherein the casing includes a passage and the adjustment mechanism is housed in the passage.

6. The firearm of claim 2, wherein the casing includes a set screw, and the set screw is configured to displace the roller against the switch actuator.

7. The firearm of claim 1, wherein the trigger lever is connected to the roller at one end of the trigger lever, and an opposite end of the trigger lever is connected a rearwardly extending arm connected to the trigger.

8. The firearm of claim 1, further comprising a fastening member attaching the grip assembly to the lower receiver, wherein the fastening member includes a slot and the trigger lever extends along the fastening member in the slot.

9. The firearm of claim 1, further comprising a fastening member attaching the grip assembly to the lower receiver, wherein the fastening member includes a threaded shaft threadingly engaged to the lower receiver.

10. The firearm of claim 9, further comprising a chassis engaged to the lower receiver via the fastening member.

11. The firearm of claim 10, wherein the chassis includes:

a base engaged to the lower receiver with the fastener;

a lower rail extending from one end of the base; and an upper rail extending from an opposite end of the base.

12. The firearm of claim 11, wherein the grip assembly is attached to the lower rail and the upper rail of the chassis.

13. The firearm of claim 1, wherein the trigger is pivotally coupled with the sear assembly, wherein the trigger includes a trigger arm extending rearwardly from the pivotal coupling of the trigger with the sear assembly, and the trigger lever is connected with a rearward end of the trigger arm.

14. The firearm of claim 13, wherein:

the trigger lever includes an engagement arm;

the trigger arm includes a receptacle; and the engagement arm of the trigger lever is engaged in the receptacle of the trigger arm.

15. The firearm of claim 13, wherein:

the trigger lever includes an L-shaped engagement member at one end of the trigger lever;

the roller is engaged to the L-shaped engagement member; and the trigger lever is configured to displace the roller to ride along the switch actuator associated with the switch to actuate the switch in response to a pull of the trigger.

16. An electronic firing system for firing a firearm by pulling a trigger, the system comprising:

a switch actuator engaged to a switch;

a trigger lever connectable to the trigger;

a fastening member configured to attach a grip assembly to a lower receiver of the firearm, wherein the trigger lever is reciprocally moveable along the fastening member; and a roller engaged to the trigger lever, wherein the roller is configured to move along the switch actuator in response to a pull of the trigger that displaces the trigger lever, thereby displacing the switch actuator to engage the switch for electronically firing the firearm.

17. The system of claim 16, wherein the fastening member is configured to guide longitudinal movement of the trigger lever along the fastening member in response to a pull of the trigger as the trigger lever is displaced.

18. The system of claim 16, further comprising a casing mounted to the grip assembly, wherein:

the roller is housed in the casing mounted to the grip assembly; and the casing includes an adjustment mechanism that is configured to adjust a force required to displace the roller by pulling the trigger.

19. The system of claim 18, wherein the adjustment mechanism includes:

a ball member in contact with the roller;

an adjustment screw engaged to the casing; and a spring between the ball member and the adjustment screw.

20. The system of claim 16, further comprising a chassis engaged to the lower receiver via the fastening member, wherein the chassis includes:

a base engaged to the lower receiver with the fastener;

a lower rail extending from one end of the base; and an upper rail extending from an opposite end of the base, wherein the grip assembly is mounted to the chassis via the lower and upper rails.

* * * * *